United States Patent [19]

Rysewyk

[11] Patent Number: 4,940,381

[45] Date of Patent: Jul. 10, 1990

[54] MOBILE HOIST

[75] Inventor: Ambrose L. Rysewyk, Elgin, Ill.

[73] Assignee: American Telephone and Telegraph Company, New York, N.Y.

[21] Appl. No.: 237,253

[22] Filed: Aug. 26, 1988

[51] Int. Cl.[5] ..... B66F 19/00

[52] U.S. Cl. ..... 414/619; 187/9 R; 294/74; 414/607

[58] Field of Search ..... 187/9 R, 9 E, 17, 29.2, 187/42; 414/618, 592, 785; 212/268, 203; 294/74; 251/251

[56] References Cited

U.S. PATENT DOCUMENTS

| | | | |
|---|---|---|---|
| 2,603,522 | 7/1952 | Stair | 294/74 |
| 2,785,817 | 3/1957 | Pappathatos et al. | 187/9 R X |
| 2,875,852 | 3/1959 | Morrell | 187/9 R |
| 3,019,929 | 2/1962 | Gardner et al. | 414/607 |
| 3,086,618 | 4/1963 | Christiansen | 187/9 R |
| 3,154,166 | 10/1964 | Underwood et al. | 187/9 R |
| 3,217,836 | 11/1965 | Darimont | 187/9 R |
| 3,858,736 | 1/1975 | French, Jr. et al. . | |
| 4,239,443 | 12/1980 | Rysewyk | 414/618 |

FOREIGN PATENT DOCUMENTS

| | | | |
|---|---|---|---|
| 1050045 | 2/1959 | Fed. Rep. of Germany | 187/9 R |
| 3327848 | 2/1985 | Fed. Rep. of Germany | 187/9 R |
| 327065 | 8/1970 | Sweden | 187/9 R |

*Primary Examiner*—Frank E. Werner
*Attorney, Agent, or Firm*—A. A. Tirva

[57] ABSTRACT

A mobile hoist for loading and unloading heavy objects onto and from shelves in space limited quarters includes a hydraulic cylinder piston combination for elevating and lowering the objects utilizing a platform or a boom which may be attached to the piston. The piston moves up and down in response to a flow of hydraulic fluid to and from the hydraulic cylinder. The flow of the hydraulic fluid is controlled by a metering valve which is opened and closed by a cam driven arrangement designed to ensure that the fluid flow through the metering valve is nonlinear enabling soft, no shock stops regardless of the weight of the objects being elevated or lowered. The boom includes a sling lock mechanism which allows for placement of objects in locations with limited clearances.

10 Claims, 6 Drawing Sheets

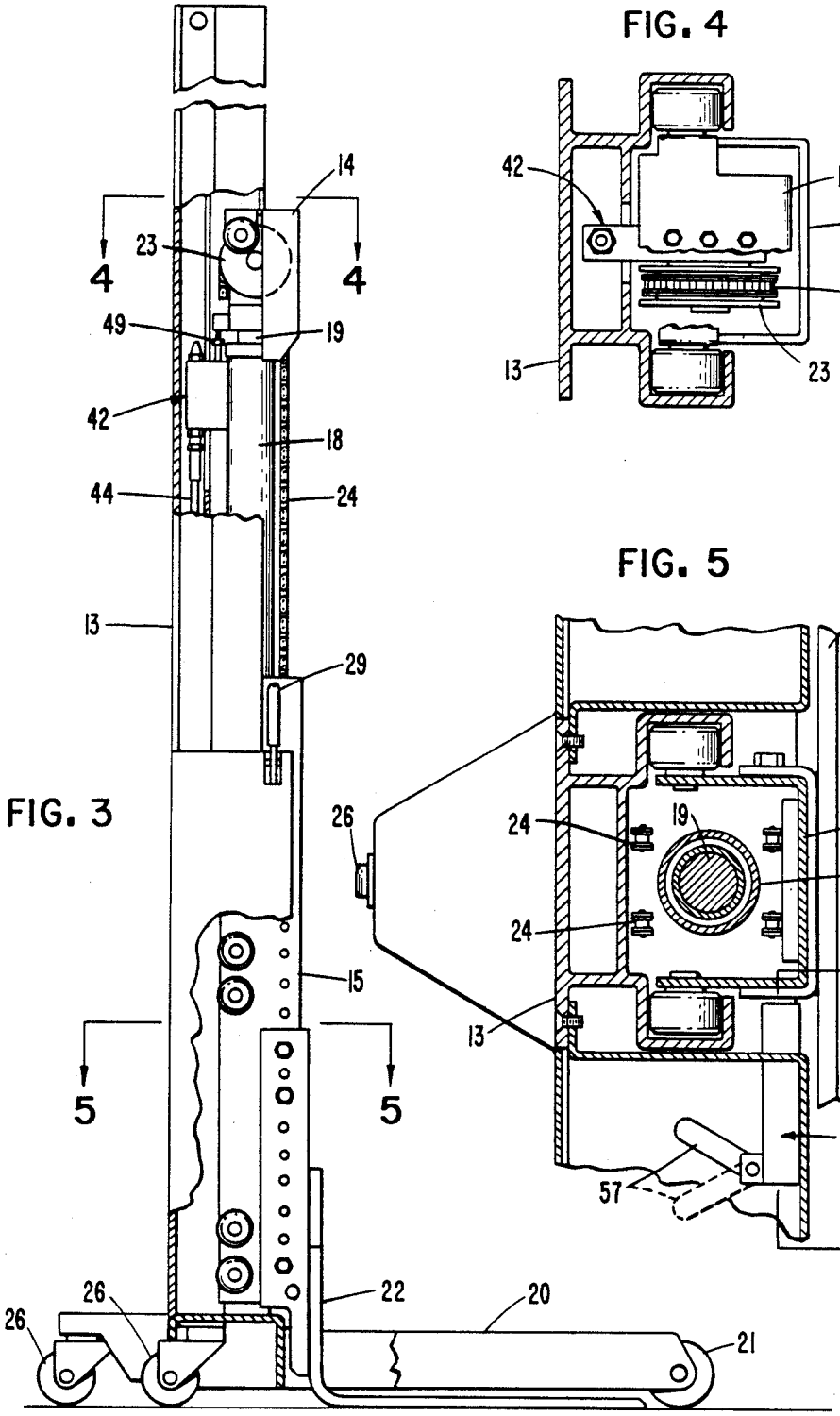
FIG. 3
FIG. 4
FIG. 5
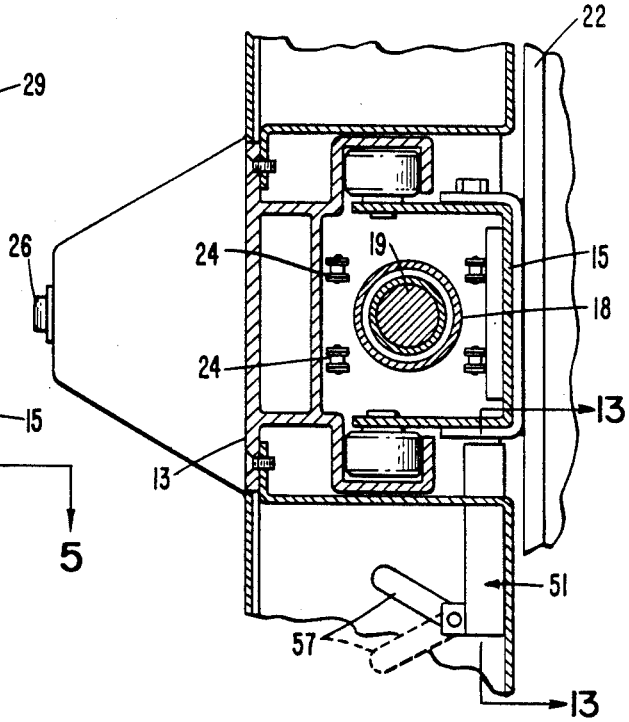

MOBILE HOIST

TECHNICAL FIELD

This invention relates to mobile hoists and more particularly, to a hoist for lifting articles and moving the articles for placement onto a shelf in space-limited locations.

BACKGROUND OF THE INVENTION

In warehousing of heavy articles, there is a continuous need for mobile, lightweight hoist vehicles for placing and removing articles to and from multi-tiered shelves. In the construction of such hoists, consideration must be given to providing a hoist that can be moved along relatively narrow aisles without interferences with overhanging wiring, plumbing and duct work. There are also needs for such hoists to load and unload heavy battery cells on shelves for use as emergency power supplies for telephone exchanges or as energy sources for computer installations. Additionally, such hoists should be easily transportable from one location to another.

Numerous diverse types of lift trucks, mobile hoists and gantry arrangements have been developed to facilitate the placing and removal of heavy objects onto and from multi-tiered shelving. One example of a hoist that has been developed to move round cell batteries onto and from multi-tiered shelving is shown in R. C. French et al. U.S. Pat. No. 3,858,736 issued Jan. 7, 1975. In this patent a castered flat platform supports a rotatably mounted pole from which laterally extends a slide and tong-like clamp assembly. The clamp assembly is movably mounted on the pole so that an article can be lifted and orbited about the pole and then moved over and onto a shelf. Laterally extending foldable, stabilizing arms are provided to counteract forces tending to tilt the hoist during loading and unloading operations.

Another example of a mobile hoist is shown in U.S Pat. No. 4,239,443, issued Dec. 16, 1980 to applicant in the instant application. The mobile hoist described in this patent includes an open frame structure for receiving an article which is clamped, lifted and then moved from within the frame structure onto a shelf.

While the above-mentioned hoists were commercially available and have been utilized in the field with various degrees of success, placement of round cell batteries in space limited quarters requires more and more compact, lighter and easily transportable hoists which are not only powerful enough to lift and lower the round cell batteries but additionally perform the lifting and the lowering actions in a smooth and jerk-free manner. The smooth start-stop actions are difficult, if not impossible to achieve with the above-mentioned hoists.

DISCLOSURE OF THE INVENTION

In accordance with the present invention, I provide a mobile hoist having a footprint which is approximately one-half the size of the footprint and one-third the weight of the prior art mobile hoists. The hoist utilizes a hydraulic cylinder-piston combination to elevate and lower a load bearing platform or a boom attached to the piston and includes a hydraulic cam operated, metering valve ensuring that the hydraulic fluid flow through the valve is nonlinear enabling smooth start-stop action of the hoist no matter how heavy or light the load. A shuttle valve used to vent the hydraulic cylinder and the hydraulic reservoir to the atmosphere prevents hydraulic fluid leaks when the hoist is shipped in the prone position.

BRIEF DESCRIPTION OF THE DRAWING

FIG. 3 is a side view partially in section of the hoist shown in FIG. 1.

FIG. 4 is a sectional view of the hoist taken along line 4—4 of FIG. 3.

FIG. 5 is a section view of the hoist taken along line 5—5, of FIG. 3.

DETAILED DESCRIPTION

Figure 1:
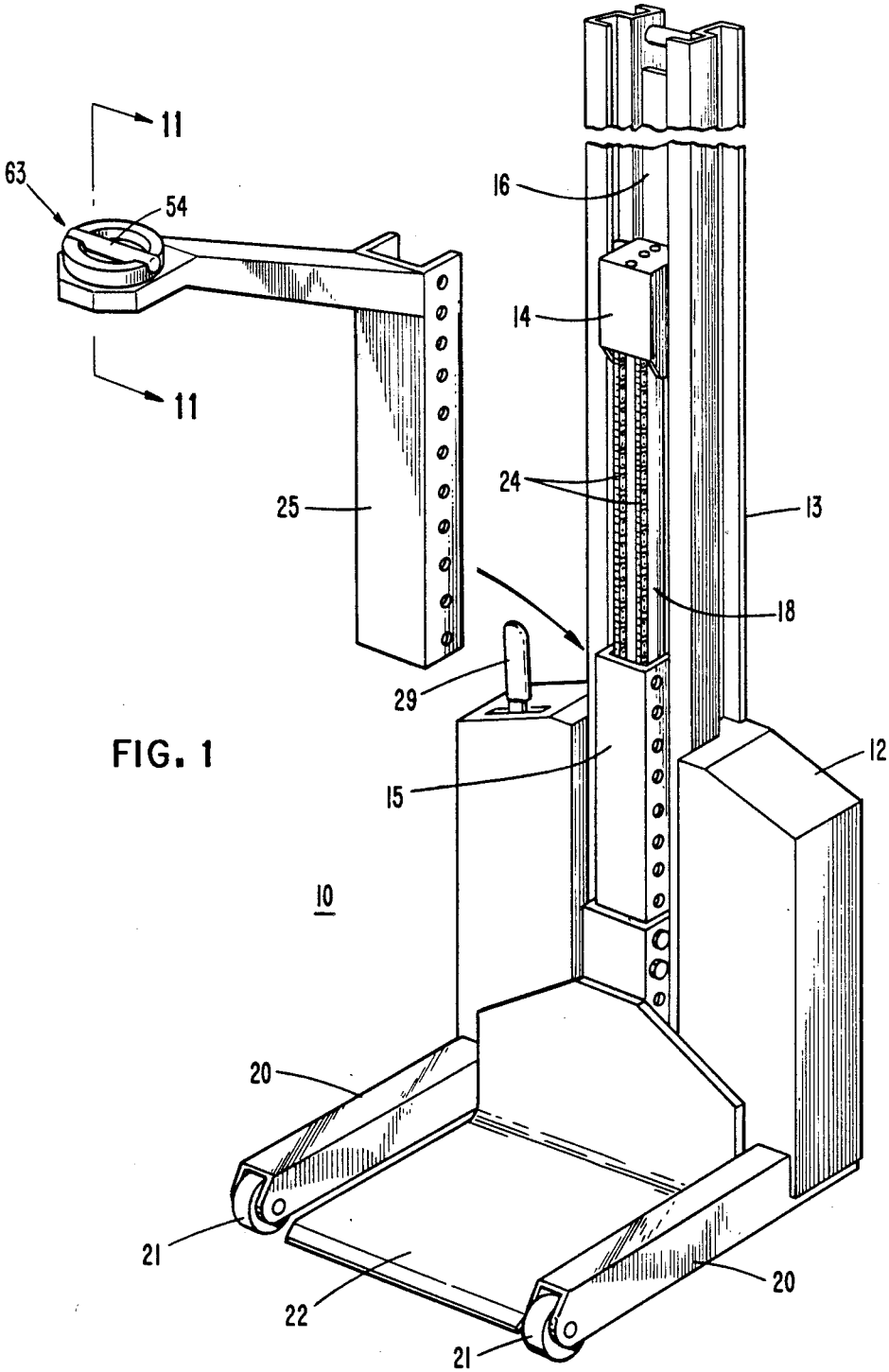
FIG. 1 is a perspective view of the mobile hoist embodying the principles of the present invention.
Figure 2:
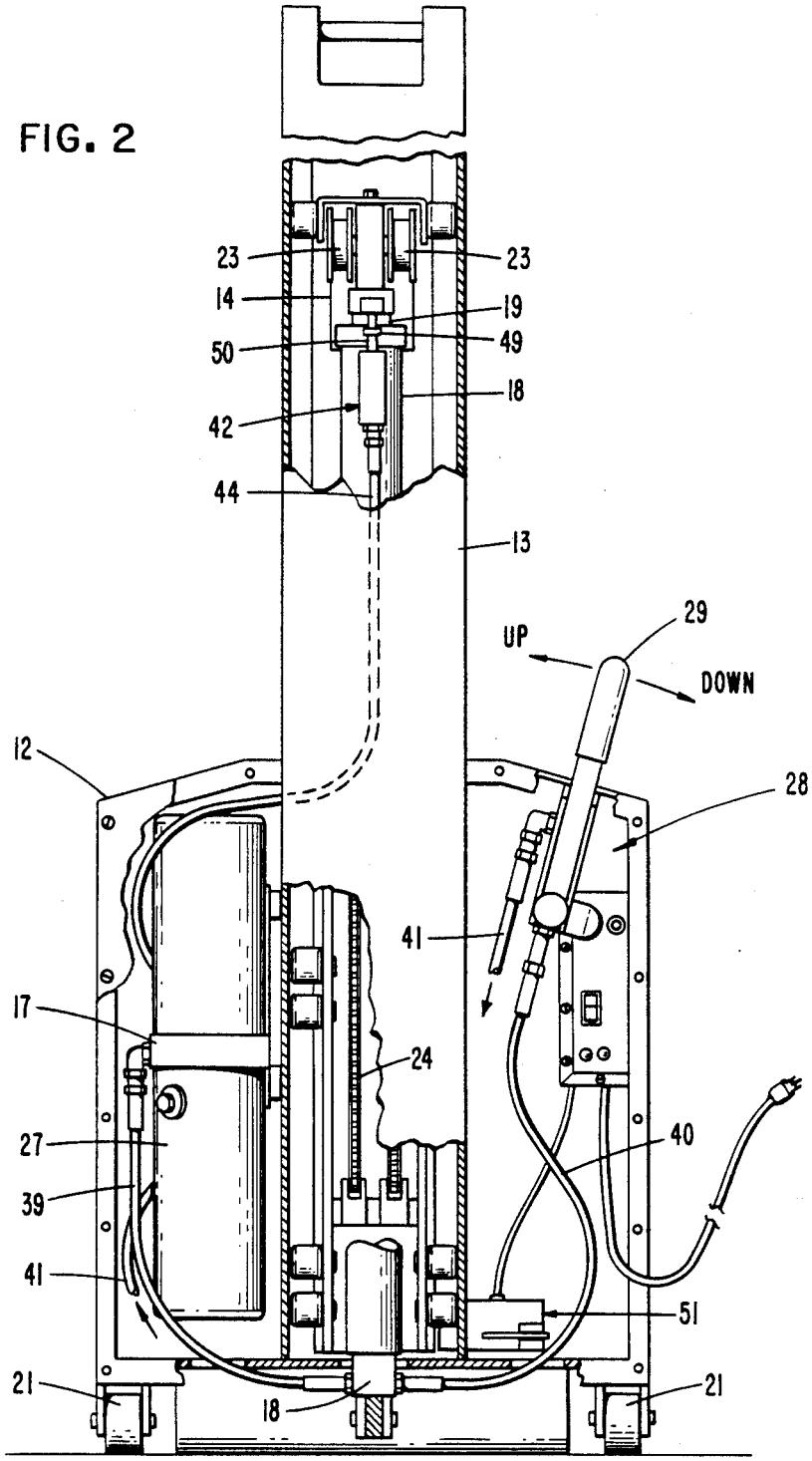
FIG. 2 is a back view partially in section of the hoist shown in FIG. 1.

In general, a hoist 10 as shown in FIG. 1 comprises a rectangular shaped, elongated housing 12 on which is mounted a vertically extending mast 13 that provides a mounting for a multi-slide arrangement consisting of an upper slide 14 and a lower slide 5. Both slides 14 and 15 are supported in a channel shaped track 16. Channel 16 also houses a hydraulic cylinder assembly which includes a hydraulic cylinder 18 containing a piston 19, portions of both are shown in FIG. 2. The housing 12 and mast 13 are supported by a pair of legs 20 which extend horizontally from the front of the housing 12. Each leg 20 terminates in a roller 21. The base of the housing 12 is supported by three casters 26 placed in a triangular relationship. Two of the casters 26 are shown in FIG. 3. A platform 22 is releasably attached to the lower slide 15. In place of the platform 22, a boom 25 may be releasably mounted on the lower slide 15.

Upper slide 14 is attached to the top of the piston 19 and houses two sheaves 23 which are rotatably mounted within the slide 14. A pair of chains 24, each chain being looped around one of the sheaves 23, has one end attached to the lower slide 15 and the other end to the housing 12. Movement of the piston 19 in the upward direction (extending it out of the hydraulic cylinder 18) also moves the sheaves 23 and since one end of each chain 24 is secured to the housing 12, the portion of the chain between the upper slide 14 and the platform 22 will shorten causing the platform 22 to rise. Lowering the piston 19 increases the length of the portion of chain 24 between the upper slide 14 and the platform 22 thereby lowering the platform 22.

Figure 7:
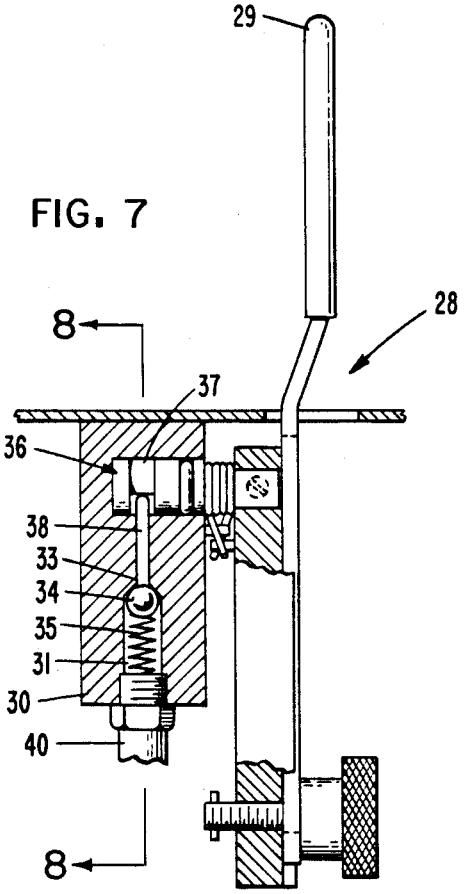
FIG. 7 is an enlarged partial sectional view of the metering valve shown in FIGS. 1 and 2.
Figure 8:
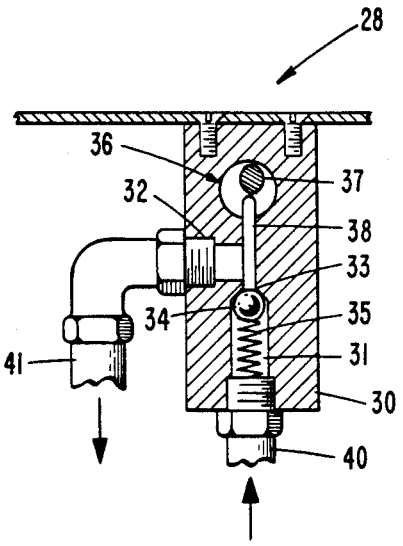
FIG. 8 is a sectional view of the metering valve taken along line 8—8 of FIG. 7.
Figure 9:
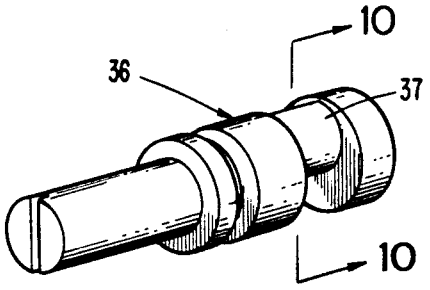
FIG. 9 is an enlarged perspective view of a cam assembly of the metering valve shown in FIGS. 7 and 8.

To effect the movement, as well as, to control the rate of the movement of the piston 19 a hydraulic system comprised of the before-mentioned hydraulic cylinder 18 containing piston 19 additionally includes a hydraulic fluid reservoir 27, and a metering valve assembly 28, as best shown in FIGS. 2 and 7. The metering valve assembly 28 has a valve body 30 which includes an inlet chamber 31 and an outlet chamber 32. The inlet and outlet chambers are connected by a passage 33. A sperical ball 34 is located in the inlet chamber 31 and is normally held against one end of the passage 33 by a spring 35, thereby blocking the flow of hydraulic fluid from the inlet chamber 31 to the outlet chamber 32. A cam assembly 36 is rotatably mounted within the valve body 30 and has attached to it a control lever 29 which is mounted outside the valve body 30. Movement of the lever 29 rotates the cam assembly 36 within the valve body 30. Cam assembly 36 includes a cam 37 and a cam follower 38 which is positioned within the valve body 30 such that it is in continuous contact with the surface of cam 37 and the surface of the sperical ball 34. Dimensions of the cam 37 and the cam follower 38 are such that when the control lever 29 is in the position designated as "OFF", the sperical ball 34 is held by spring 35 against the passage 33 blocking the flow of hydrulic fluid from the inlet chamber 31 to the outlet chamber 32. When the control lever 29 is moved to positions designated "UP" or "DOWN", the cam follower 38 acts against the spherical ball 34 in accordance with the cam displacement diagram as shown in FIG. 10.

Connections of the hydraulic circuit for moving piston 19 up or down are as follows. As shown in FIG. 2, the hydraulic reservoir 27 is connected via hose 39 to the hydraulic cylinder 18. The hydraulic cylinder 18 is connected via hose 40 to the inlet chamber 31 of the valve body 30. A hose 41 connects the outlet chamber 32 of the valve body 30 to the hydraulic reservoir 27. The hydraulic system operates as follows. When the control lever 29 is moved to the "UP" position, electrical power is supplied to a pump 17 which pumps hydraulic fluid, in a manner well known in the art, out of the reservoir 27 via hose 39 to the cylinder 18 and via hose 40 to the inlet chamber 31 of the valve body 30. As can be seen from the cam displacement diagram shown in FIG. 10, when the control lever 29 is in the "UP" position spring 35 holds the sperical ball 34 against one end of the passage 33 blocking the flow of the hydraulic fluid through the passage 33 whereby the hydraulic fluid is forced into the bottom portion of cylinder 18 causing piston 19 to rise. Movement of the piston 19 in the upward direction will in turn cause platform 22 to move up for the reasons which were discussed previously. When the platform 22 is elevated to a desired height, control lever 29 is moved back to the "OFF" position shutting off the pump. Hydraulic fluid is prevented by a check valve (not shown) from flowing back into the reservoir 27 via hose 39 and via hose 41 by ball 34 through the valve body 30. Thus, the hydraulic fluid remains in cylinder 18 and the piston 19 and the platform 22 remain in the elevated position.

Figure 10:
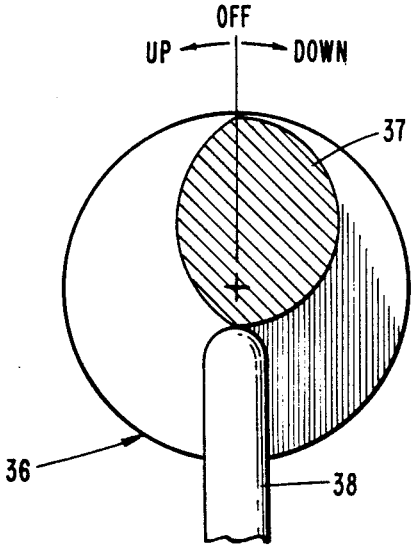
FIG. 10 is a displacement diagram of the cam and the cam follower as shown in FIGS. 7, 8 and 9.

To lower the platform 22, control lever 29 is moved to the "DOWN" position whereby cam follower 38, in accordance with the displacement diagram shown in FIG. 10, will force spherical ball 34 to move away from the passage 33 allowing hydraulic fluid to flow from cyliner 18 through hose 40 and passage 33 back via hose 41 into the reservoir 27. Evacuation of the fluid from cylinder 18 will allow piston 19 to move down and will result in the lowering of platform 22.

As can be best seen from the cam displacement diagram shown in FIG. 10, the displacement of the cam follower 38 is nonlinear in that the spherical ball 34 provides an opening of less than 0.001 of an inch for the first 5 degrees of cam 37 movement to over 0.020 of an inch for the last 5 degrees of the cam movement. This nonlinear hydraulic metering of the fluid allows precise control and soft, jerk-free stops of the platform 22 regardless of the weight, of the load and/or the suddenness of the stops.

Figure 6:
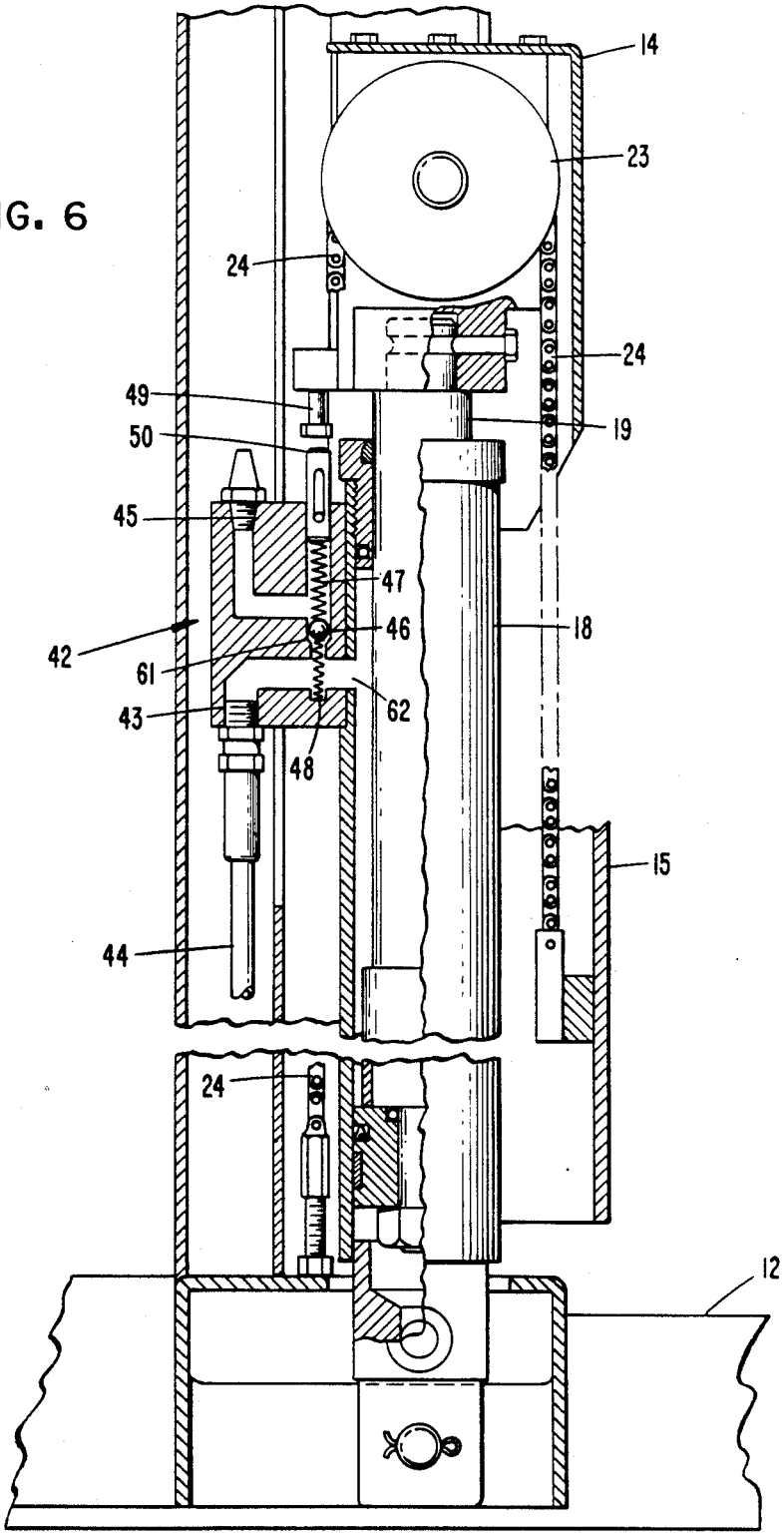
FIG. 6 is an enlarged partial sectional view of certain components of the hoist as shown in FIG. 3.

To prevent a vacuum from forming in the hydraulic reservoir 27 and the hydraulic cylinder 18, both are vented to the atmosphere via a shuttle valve arrangement 42 as is best shown in FIG. 6. The shuttle valve 42 has a port 43 which is connected to the upper most portion of hydraulic reservoir 27 via a hose 44 and a port 62 which opens into the top portion of the hydraulic cylinder 18. A port 45 vents the valve 42 to the atmosphere. Ports 43 and 62 are connected to the venting port 45 via a tapered passage 61 which contains a sperical ball 46 normally held in a position within the passage 61 between springs 47 and 48 exerting forces on the sperical ball 46 such that during normal operating conditions of the hoist, the sperical ball 46 permits passage of air to and from the hydraulic reservoir 27 and hydraulic cylinder 18. When the piston 19 is lowered to its lowest possible position within cylinder 18 an adjustable bolt 49 mounted on the piston 19 contacts and pushes a sliding spring keeper 50 compressing spring 47. The compression of spring 47 caused by the movement of the sliding spring keeper 50 forces the sperical ball 46 into the tapered end of the passage 61 thereby sealing the passage and preventing hydraulic fluid from leaking from the hydraulic fluid 27 reservoir and the hydraulic cylinder 18 when the hoist is in the prone position during shipment from one location to another.

Figure 13:
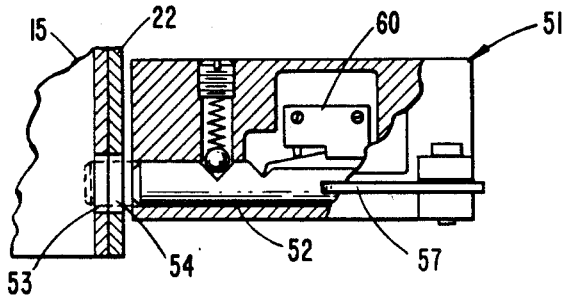
FIG. 13 is an enlarged partial sectional view of the shipping lock mechanism shown in FIG. 5 taken along line 13—13 of FIG. 5.

To prevent damage to the hoist 10 while it is transported from one location to another a shipping lock mechanism 51, as best shown in FIGS. 5 and 13, is utilized to lock the lower slide 15 to the base 12. The shipping lock mechanism 51 is mounted on the base 12 and includes a sliding bolt 52 which, in response to movement of a lever 57 attached to it, is arranged to slide through apertures 53 and 54 located in the lower slide 15 and a portion of platform 22, respectively. When the sliding bolt 52 is in the locked position, it contacts a micro switch 60 which, in a manner well known in the art, prevents application of electrical power to the hoist.

Figure 11:
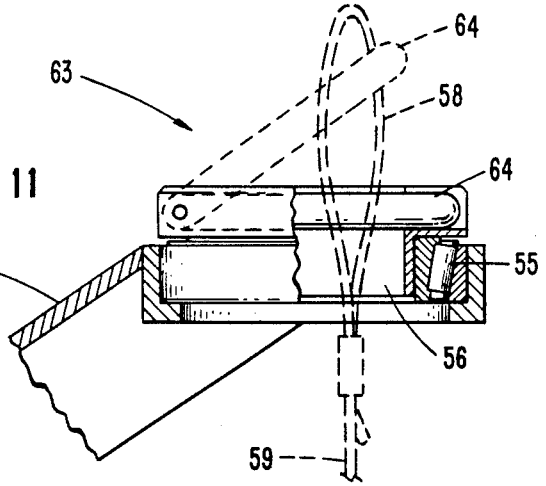
FIG. 11 is an enlarged partial sectional view of the boom shown in FIG. 1 taken along line 11—11 of FIG. 1.
Figure 12:
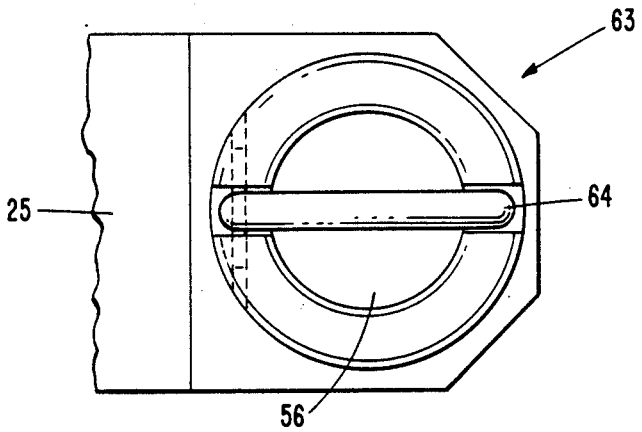
FIG. 12 is an enlarged partial top view of the boom shown in FIG. 1.

FIGS. 11 and 12 illustrate how a load supported by a sling can be easily attached and oriented when boom 25 is utilized. FIGS. 11 and 12 show a sling lock mechanism 63 which includes a pivotally mounted pin 64 which in turn is rotatably supported by a plurality of roller bearing 55, only one of which is shown in FIG. 11. As illustrated in FIG. 11, a loop portion 58 of the sling 59 attached to a load (not shown) when inserted from below through an opening 56 in the sling lock mechanism 63 pushes the pin 64 up until the loop 58 can slip over the pin 64. The boom 25 then can be elevated lifting the load attached to the sling 59 and the load cam be easily rotated regardless of the weight of the load, because of the roller bearing 55 support for the mounting pin 64.

Another advantage of the above-described sling lock mechanism 63 is that it allows placement of a load supported by the sling 59 in locations with limited clearances such as multi-tier shelves, because clearance required utilizing the boom 25 with the sling lock mechanism 64 is limited only by the envelope formed by the sling 59 while supporting a load.

What is claimed is:

1. A hoist comprising:

an elongated housing;

a mast extending upwards from said housing;

a hydraulic cylinder mounted in an upward position within said mast;

a piston slidably mounted within said cylinder having one of its ends extending from the upward end of said cylinder;

an upper slide slidably mounted on said mast and attached to the portion of the piston extending from said cylinder;

a lower slide slidably mounted on said mast;

means for interconnecting said upper and lower slides;

a load lifting means attached to said lower slide;

a hydraulic system for generating a hydraulic fluid flow to or from said cylinder;

a metering valve for regulating said hydraulic fluid flow to and from said cylinder such that hydraulic fluid flow through said valve is nonlinear, said metering valve including;

a valve body having an inlet and an outlet port;

a passage connecting said ports;

a spherical ball positioned in said inlet port;

a spring for keeping said ball against the connecting passage thereby blocking said passage to prevent hydraulic fluid flow through said passage;

a cam having a camming surface of predetermined shape and dimension;

a structure for rotatably supporting said cam;

a control lever affixed to said cam for rotating said cam;

means in contact with said camming surface and with said spherical ball for moving said ball away from the passage to allow hydraulic fluid flow through the passage; and a shuttle valve means which vents the hydraulic system to the atmosphere allowing said piston to extend from the cylinder and prevents hydraulic fluid leaks from the hydraulic system when said piston is in its lowest position within the cylinder.

2. The hoist in accordance with claim 1 wherein said hoist includes a means for locking said lower slide to said housing.

3. The hoist in accordance with claim 2 wherein said locking means includes means for preventing electrical power from being applied to the hoist.

4. The hoist in accordance with claim 1 wherein said load lifting means comprises a platform.

5. The hoist in accordance with claim 1 wherein said load lifting means comprises a boom.

6. The hoist in accordance with claim 5 wherein said boom includes:

means for attaching a sling supporting a load; and means for rotatably supporting said attaching means.

7. The hoist in accordance with claim 1 wherein said means for interconnecting the upper and lower slides includes:

a sheave rotatably mounted on the upper slide; and a chain looped around said sheave, the chain having one end attached to the lower slide and the other end to the housing.

8. The hoist in accordance with claim 1 wherein said housing is movably supported by a plurality of casters.

9. The hoist in accordance with claim 1 wherein said housing has a pair of parallel legs extending horizontally from the bottom of said housing.

10. The hoist in accordance with claim 9 wherein each leg terminates in a roller.

* * * * *